US008176756B2

(12) United States Patent
Yim et al.

(10) Patent No.: US 8,176,756 B2
(45) Date of Patent: May 15, 2012

(54) DRAIN PUMP AND WASHING MACHINE HAVING THE SAME

(75) Inventors: Woong Sub Yim, Suwon-si (KR); Jae Hyun Jang, Suwon-si (KR); Chan Woo Park, Anyang-si (KR); Sang Ho Seo, Suwon-si (KR); Hong Seok Ko, Yongin-si (KR); Seok In Hong, Suwon-si (KR); Jae Won Lee, Seoul (KR); Do Yeon Kim, Seoul (KR); Yong Kwon Kim, Daejeon-si (KR); Dong Woo Shin, Daejeon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 393 days.

(21) Appl. No.: 12/453,670

(22) Filed: May 18, 2009

(65) Prior Publication Data

US 2010/0095713 A1 Apr. 22, 2010

(51) Int. Cl.
*D06F 39/08* (2006.01)

(52) U.S. Cl. ..... 68/184; 68/208

(58) Field of Classification Search ..... 68/208, 68/184

See application file for complete search history.

(56) References Cited

U.S. PATENT DOCUMENTS 4,566,970 A * 1/1986 Piai et al. ..... 210/409

FOREIGN PATENT DOCUMENTS

| | | | |
|---|---|---|---|
| DE | 25 54 544 | * | 6/1977 |
| DE | 38 02 890 | * | 8/1989 |
| DE | 10 2004 039 436 | * | 2/2006 |
| FR | 2 751 241 | * | 1/1998 |
| JP | 2001-330079 | * | 11/2001 |
| JP | 2004-215937 | * | 8/2004 |
| JP | 2005-036762 | * | 2/2005 |
| JP | 2006-015122 | * | 1/2006 |
| KR | 2002046688 | * | 6/2002 |
| KR | 2005076110 | * | 7/2005 |
| KR | 2005108606 | * | 11/2005 |
| KR | 2006041104 | * | 5/2006 |
| KR | 2006085812 | * | 7/2006 |
| KR | 10-2007-0107448 | | 11/2007 |

* cited by examiner

*Primary Examiner* — Frankie L Stinson
(74) *Attorney, Agent, or Firm* — Staas & Halsey LLP

(57) ABSTRACT

A drain pump including a case including a mounting bracket; a first connection member mounted to the mounting bracket to be spaced from the cabinet; a second connection member inserted in the first connection member; and a fastening member passed through the cabinet and inserted in the second connection member so that the case is mounted to the cabinet. Since the first connection member is spaced from the cabinet, the second connection member can be prevented from being damaged by vibration of the drain pump.

16 Claims, 5 Drawing Sheets

DRAIN PUMP AND WASHING MACHINE HAVING THE SAME

CROSS-REFERENCE TO RELATED APPLICATIONS

This application claims the benefit of Korean Patent Application No. 2008-0102774, filed on Oct. 20, 2008 in the Korean Intellectual Property Office, the disclosure of which is incorporated herein by reference.

BACKGROUND

1. Field

The present invention relates to a washing machine, and more particularly, to a washing machine capable of attenuating vibration and noise generated from a drain pump thereof.

2. Description of the Related Art

Generally, a washing machine, as an apparatus that washes laundry by rotating a rotational tub holding the laundry with wash water therein, includes a drain pump to discharge the wash water from a water tub to the outside. Such a drain pump is usually fixed to a cabinet, thereby incurring vibration and noise of the washing machine.

To reduce such vibration and noise caused as the drain pump operates, conventionally, the washing machine has been provided with a fixing screw, a fastening part protruded from the drain pump to fasten the fixing screw, a fastening hole formed at the cabinet of the washing machine to let the fastening part penetrate, and a buffering member interposed between an outer surface of the fastening part and the fastening hole.

Although the above structure is effective in reducing the vibration and noise caused by the drain pump, however, the buffering member may be damaged after a long time use by being in contact with the fixing screw, as interposed between the fastening part and the fastening hole of the cabinet.

SUMMARY

According to example embodiments, there may be provided a washing machine capable of preventing damage of a buffering member provided to attenuate vibration and noise generated from a drain pump.

Additional aspects and/or advantages of the example embodiments will be set forth in part in the description which follows and, in part, will be apparent from the description, or may be learned by practice of the invention.

In accordance with one aspect of the present invention, there is provided a washing machine including a cabinet, a water tub in the cabinet, and a drain pump mounted to the cabinet to drain wash water from the water tub, wherein the drain pump includes a case including a mounting bracket, a first connection member mounted to the mounting bracket to be spaced from the cabinet, a second connection member inserted in the first connection member, and a fastening member passed through the cabinet and inserted in the second connection member so that the case is mounted to the cabinet.

The first connection member may be made of rubber.

The second connection member may be made by injection molding.

The first connection member may be equipped with an insertion hole to insert the second connection member therein, and the second connection member may be equipped with a fastening hole to be engaged with the fastening member.

The second connection member may be longer than the first connection member so as to protrude out of the first connection member when inserted in the insertion hole of the first connection member.

The mounting bracket may be extended to a lower part of the case, and formed with a mounting hole to which the second connection member is mounted.

The cabinet may include a base plate having a front supporting plate extended upward, and the drain pump may be mounted to the front supporting plate.

The front supporting plate may have a via hole so that the fastening member can be passed through the front supporting plate from the front side and then inserted in the fastening hole of the second connection member.

The second connection member may further include a projection part which penetrates the front supporting plate to fix a mounting position of the drain pump with respect to the front supporting plate, and the front supporting plate may be equipped with a projection insertion hole to insert the projection part therein.

In accordance with another aspect of the example embodiments, there may be provided a drain pump mounted to a cabinet of a washing machine, including a case having a mounting hole, a buffering member mounted to the mounting hole, and a connection member inserted in the buffering member and fastened to the cabinet.

The buffering member may be disposed at an interval from the cabinet.

The buffering member may be equipped with an insertion hole to insert the connection member.

The connection member may have a fastening hole, and the fastening member passed through the cabinet is inserted in the fastening hole.

In accordance with still another aspect of the example embodiments, there may be provided a washing machine including a cabinet, a water tub mounted in the cabinet to hold wash water therein, and a drain pump discharging the wash water from the water tub, wherein the drain pump includes a case, a mounting bracket disposed at one side of the case to mount the drain pump to the cabinet, and a mounting hole formed at the mounting bracket to insert a connection member connected to the cabinet, the connection member including a first member connected from an inside of the cabinet to a front side of the cabinet, and a second member enclosing an outside of the first member to thereby prevent vibration transmission between the drain pump and the cabinet.

The second member may be disposed at an interval from the cabinet.

The washing machine may further include a fastening member passed through the cabinet and fastened to the first member so that the case is mounted to the cabinet, wherein the first member has a fastening hole to insert the fastening member.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF EMBODIMENTS

Figure 1:
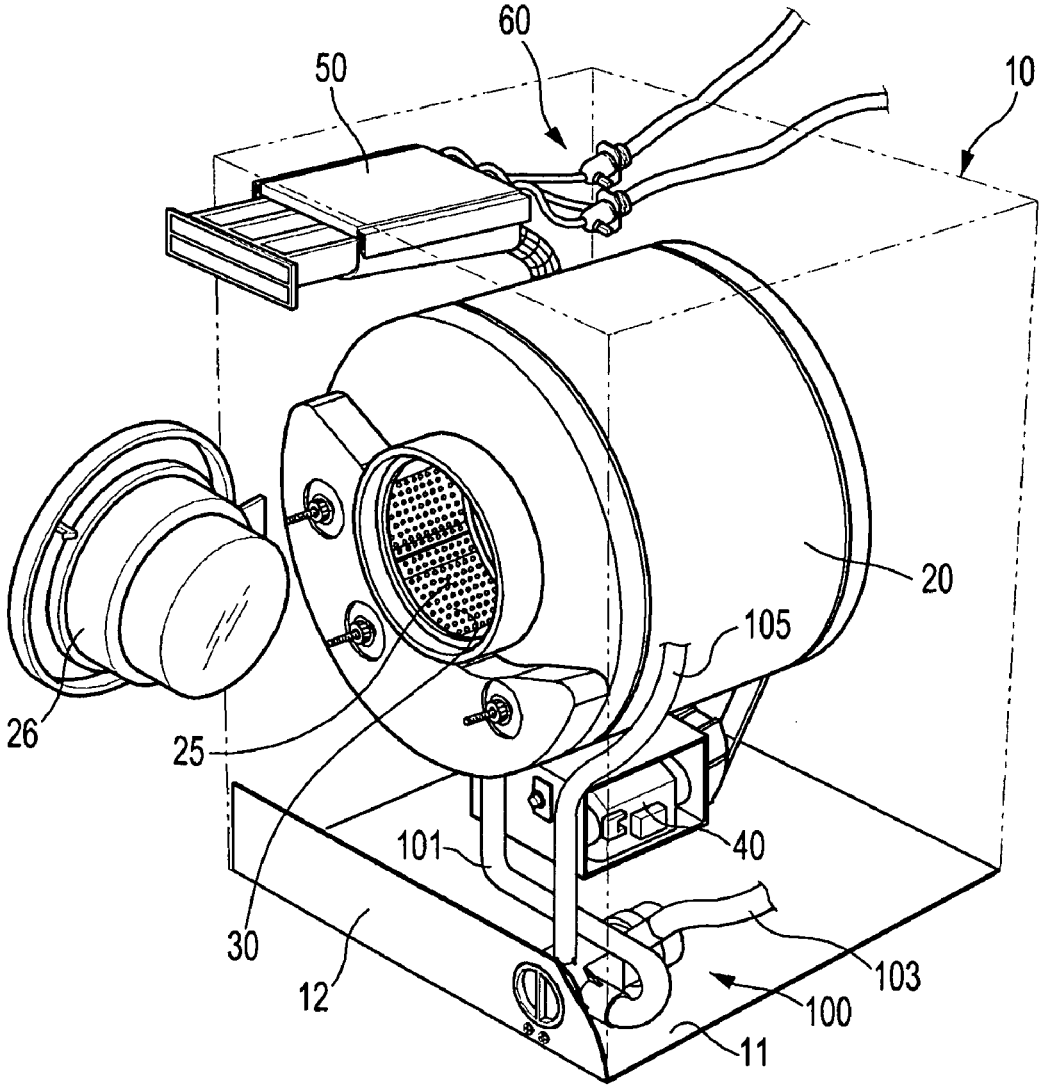
FIG. 1 is a perspective view of a washing machine according to an example embodiment.

Reference will now be made in detail to the example embodiments, examples of which are illustrated in the accompanying drawings, wherein like reference numerals refer to the like elements throughout. The embodiments are described below to explain the present invention by referring to the figures.

Referring to FIG. 1, a washing machine according to an example embodiment includes a cabinet 10 constituting the appearance thereof, a water tub 20 mounted in the cabinet 10, a rotational tub 30 rotatably mounted in the water tub 20, and a driving motor 40 mounted at a lower part of the water tub 20 to rotate the rotational tub 30.

Additionally, the washing machine further includes a water supplier 60 mounted at an upper part of the water tub 20 to supply wash water to the water tub 20, a detergent supplier 50 supplying detergent during water supply, and a drain unit 100 mounted at the lower part of the water tub 20 to forcibly discharge the wash water in the water tub 20 to the outside.

An opening 25 may be formed at front sides of the cabinet 10, the water tub 20, and the rotational tub 30 enabling laundry to be put in and out of the rotational tub 30. A door 26 to open and close the opening 25 is mounted to a front side of the cabinet 10.

Although not shown, the rotational tub 30 mounted in the water tub 20 is rotatably supported by a rotational shaft connected to the center of a rear side thereof. The rotational shaft is connected to the driving motor 40 through a pulley and a belt. According to this, the rotational tub 30 can be rotated upon rotation of the driving motor 40.

The drain unit 100, disposed at the lower part of the water tub 20, includes a drain pump 110 forcibly discharging wash water received in the water tub 20, a first drain pipe 101 interconnecting the water tub 20 and the drain pump 110, and a second drain pipe 103 extended from the drain pump 110 to the outside of the cabinet 10.

The cabinet 10 includes a base plate 11 mounted at a lower part of the washing machine, and the drain pump 110 is mounted to the base plate 11. In addition, as shown in FIG. 1 and FIG. 2, for mounting of the drain pump 110, the base plate 11 is provided with a front supporting plate 12 extended upward by a predetermined length from a front end thereof.

Figure 2:
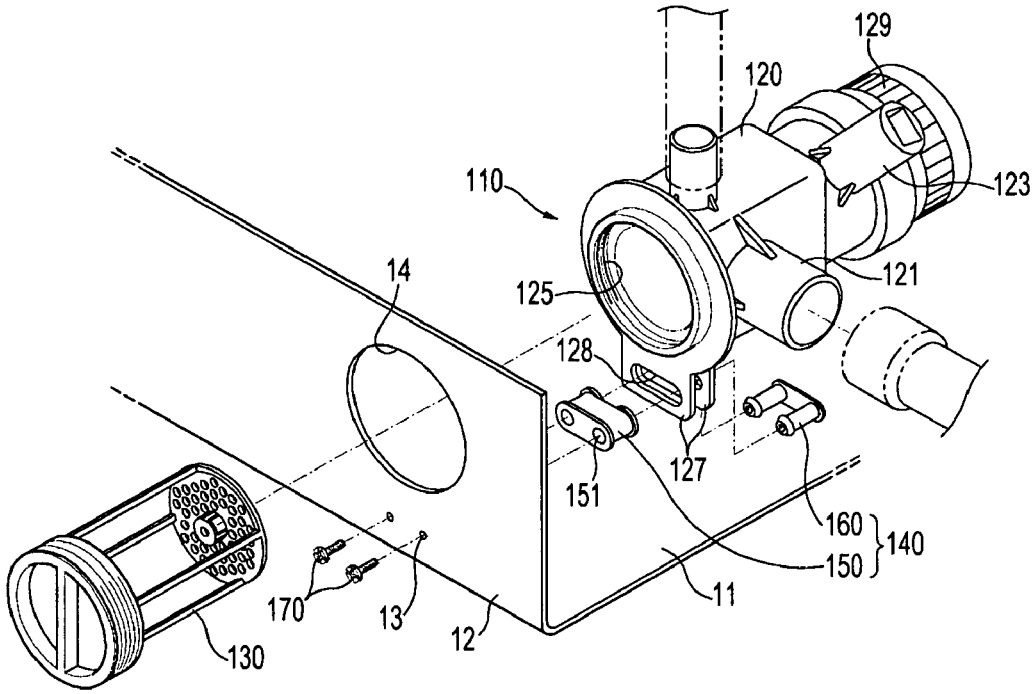
FIG. 2 is an exploded perspective view of a drain pump shown in FIG. 1.

As shown in FIG. 2, the drain pump 110 includes a case 120 constituting the appearance thereof, a drain filter 130 removably mounted to the case 120, an impeller (not shown) rotatably mounted inside the case 120, and a motor 129 mounted to the case 120 to operate the impeller.

The case 120 includes an inlet pipe 121 guiding in the wash water, and an outlet pipe 123 discharging the wash water according to the operation of the impeller. The inlet pipe 121 is connected with the first drain pipe 101 while the outlet pipe 123 is connected with the second drain pipe 103.

At an upper part of the case 120, an air discharge pipe 105 is connected to discharge air. Additionally, filter connection holes 125 and 14 for connection and separation of the drain filter 130 are formed on a front surface of the case 120 and the front supporting plate 12 of the cabinet 10.

Figure 3:
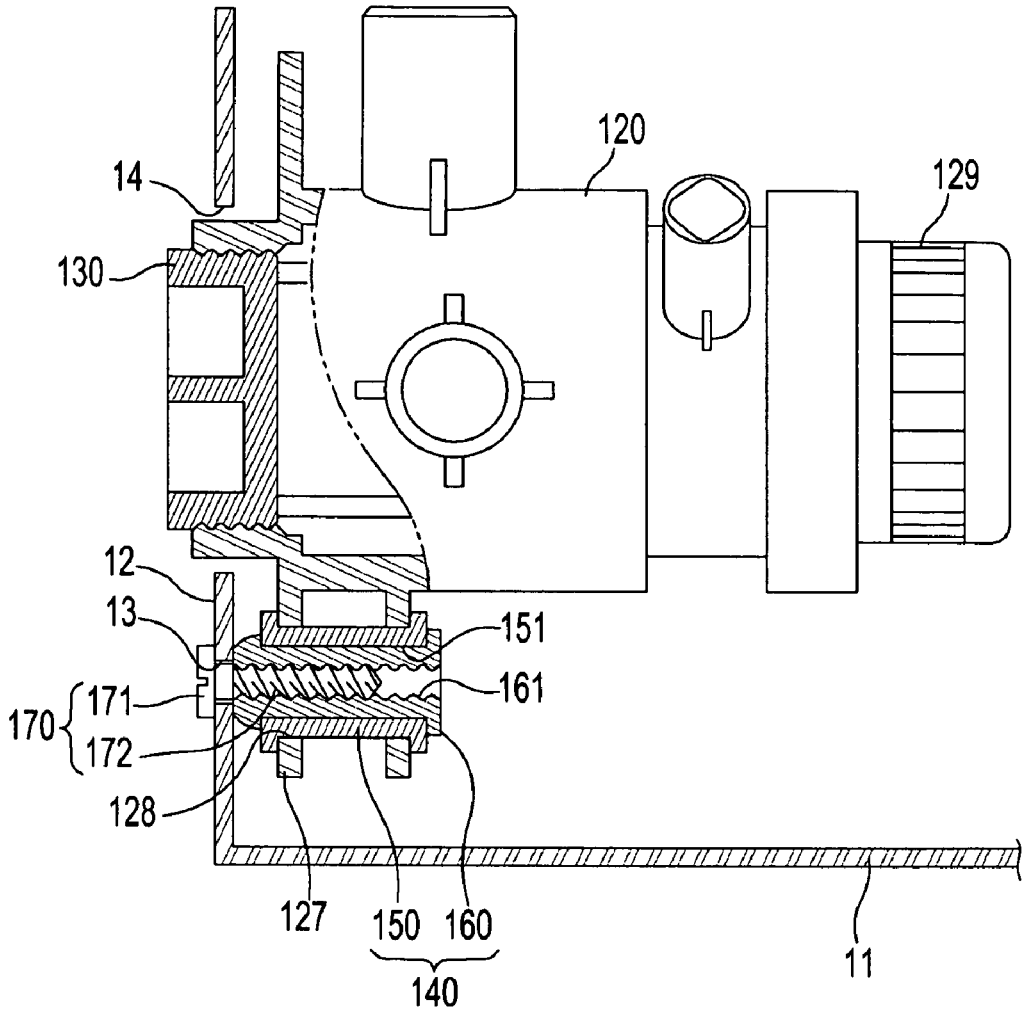
FIG. 3 is a sectional view of the drain pump of FIG. 2.

Furthermore, in order to prevent transmission of vibration from the drain pump 110 to the front supporting plate 12 or throughout the cabinet 10, the drain pump 110 includes a mounting bracket 127 disposed at one side thereof, a connection member 140 inserted in the mounting bracket 127 and connected to the front supporting plate 12, and a fastening member 170 fastened to the connection member 140 by penetrating the front supporting plate 12 as shown in FIG. 2 and FIG. 3.

The connection member 140 includes a first connection member 150 mounted to the mounting bracket 127, and a second connection member 160 inserted in the first connection member 150 and fastened to the front supporting plate 12 by the fastening member 170.

The fastening member 170 is connected to the second connection member 160, passing through the front supporting plate 12 from the front of the front supporting plate 12. For this, the front supporting plate 12 has a via hole 13 for the fastening member 170 to pass through. In addition, by being connected to the second connection member 160 through the front supporting plate 12, the fastening member 170 fixes the drain pump 110 to the front supporting plate 12.

The fastening member 170 constitutes a head part 171 and a body part 172. The head part 171 is disposed at the front of the front supporting plate 12 and penetrates the front supporting plate 12, whereas the body part 172 is disposed at the rear of the front supporting plate 12 and penetrates the front supporting plate 12 and is inserted in the second connection member 160.

As described above, the second connection member 160 is inserted with the body part 172 of the fastening member 170 and, to this end, includes a fastening hole 161 for inserting the body part 172. A screw thread is formed on an inner surface of the fastening hole 161 for engagement with the fastening member 170.

The second connection member 160 is formed by injection molding so that the fastening member 170 can be inserted and fastened therein. Such an injection-molded second connection member 160 is provided in a pair for more efficient mounting of the drain pump 110 to the front supporting plate 12. Furthermore, the pair of second connection members 160 may be integrally connected to each other to reduce the number of parts.

The first connection member 150 functions as a buffering member by being inserted in the mounting bracket 127. The second connection member 160 is inserted in the first connection member 150 as shown in the drawing. To this end, the first connection member 150 has an insertion hole 151 enclosing an outside of the second connection member 160. In addition, the first connection member 150 may also be provided in a pair and interconnected to each other in the same manner as the second connection member 160.

The first connection member 150 may be made of general rubber, silicon and the like so as to prevent vibration and noise of the drain pump 110 from being transmitted to the front supporting plate 12 or the whole cabinet 10 through connection parts of the fastening member 170 and the second connection member 160.

Moreover, in order to prevent damage by vibration in the case of a long time use, as well as effectively preventing such transmission of the vibration and noise of the drain pump 110 to the front supporting plate 12 or the cabinet 10, the first connection member 150 is spaced from the front supporting plate 12 and kept out of contact with the fastening member 170.

More specifically, the second connection member 160 has a greater length than the first connection member 150 and therefore is protruded out of the first connection member 150 when inserted in the first connection member 150, such that the first connection member 150 does not contact the front supporting plate 12 and the fastening member 170.

The mounting bracket 127 is extended downward from the front end of the case 120, and includes a mounting hole 128 where the first connection member 150 is inserted. The mounting bracket 127 may include two brackets spaced in a length direction of the case 120 so that the first connection member 150 having a predetermined length can be easily inserted in the mounting hole 128.

Figure 4:
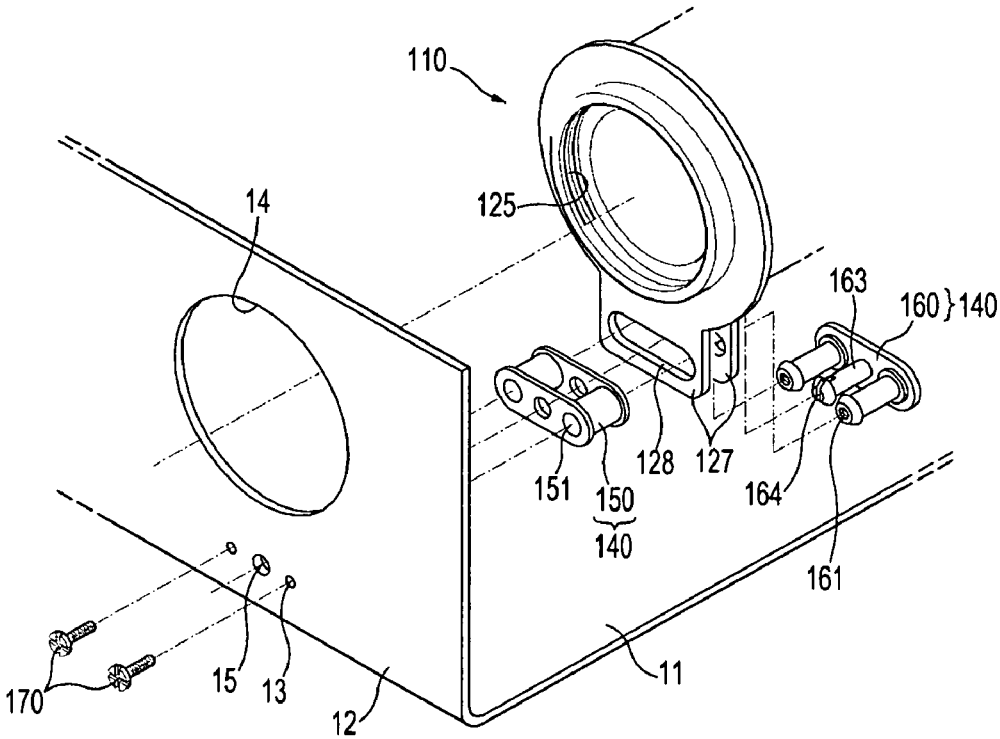
FIG. 4 is an exploded perspective view of a modified version of the drain pump shown in FIG. 1.
Figure 5:
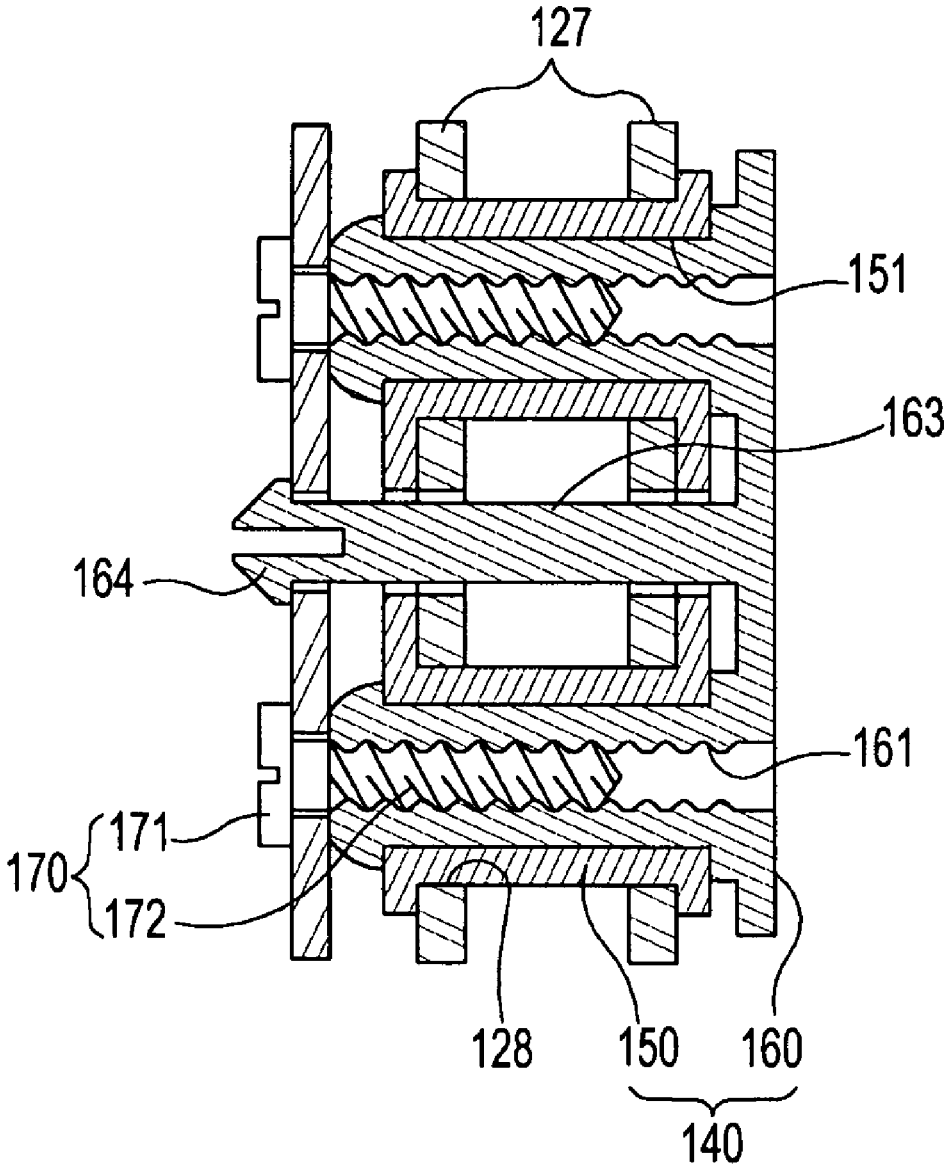
FIG. 5 is a sectional view of the drain pump of FIG. 4.

As shown in FIG. 4 and FIG. 5, the second connection member 160 may further include a projection part 163 that penetrates the front supporting plate 12 to more correctly position the drain pump 110 mounted to the front supporting plate 12. The projection part 163 may be protruded longer than parts where the fastening holes 161 are formed.

That is, the projection part 163 fixes a mounting position of the drain pump 110 with respect to the front supporting plate 12, so that the drain pump 110 can be facilely mounted to the cabinet 10. For this, the front supporting plate 12 is formed with a projection insertion hole 15 for inserting the projection part 163.

Also, on a front end of the projection part 163, a locking protrusion 164 is formed to prevent separation of the projection part 163 inserted in the projection insertion hole 15. The front end of the projection part 163, where the locking protrusion 164 is formed, is separated into two so as to be flexibly inserted in the projection insertion hole 15.

According to the above structured example embodiment, the drain pump 110 is mounted to the front supporting plate 12 of the cabinet 10 as follows. First, the first connection member 150 made of rubber is forcedly fit in the mounting hole 128 of the mounting bracket 127. Next, the injection-molded second connection member 160 is inserted in the insertion hole 151 of the first connection member 150. In addition, the fastening member 170 is passed through the via hole 13 of the front supporting plate 12 from the front side of the front supporting plate 12, and then fastened to the fastening hole 161 of the second connection member 160. Thus, mounting of the drain pump 110 to the front supporting plate 12 is completed.

As described the above, according to the example embodiment, since the outside of the injection-molded second connection member 160 inserted with the fastening member 170 penetrating the front supporting plate 12 is enclosed by the first connection member 150 made of rubber, generation of vibration and noise from the drain pump 110 can be restrained.

In addition, since the rubber first connection member 150 enclosing the outside of the second connection member 160 is spaced from the front supporting plate 12 and kept out of contact with the fastening member 170, the first connection member 150 can be protected from damage by the vibration of the drain pump 110.

Although a few example embodiments have been shown and described, it would be appreciated by those skilled in the art that changes may be made in these embodiments without departing from the principles and spirit of the invention, the scope of which is defined in the claims and their equivalents.

What is claimed is:

1. A washing machine including a cabinet, a water tub in the cabinet, and a drain pump mounted to the cabinet to drain wash water from the water tub, the cabinet including a front supporting plate disposed at the front of the drain pump, and the drain pump being mounted to the front supporting plate, wherein the drain pump comprises:

a case including a mounting bracket;

a first connection member mounted to the mounting bracket to be spaced from the cabinet;

a second connection member inserted in the first connection member, the second connection member having a portion disposed between the front supporting plate of the cabinet and the first connection member in forward and backward directions so that the first connection member is spaced from the front supporting plate; and a fastening member passed through the cabinet and inserted in the second connection member so that the case is mounted to the cabinet, the fastening member including a head part and a body part inserted in a fastening hole of the second connection member, wherein, when the fastening member is coupled to the front supporting plate and the case of the drain pump, the head part of the fastening member is supported by the front supporting plate at the front of the front supporting plate, and the body part of the fastening member is threadedly engaged with an inner surface of the fastening hole of the second connection member.

2. The washing machine according to claim 1, wherein the first connection member is made of rubber.

3. The washing machine according to claim 2, wherein the second connection member is made by injection molding.

4. The washing machine according to claim 3, wherein the first connection member is equipped with an insertion hole to insert the second connection member therein.

5. The washing machine according to claim 4, wherein the second connection member is longer than the first connection member so as to be protruded out of the first connection member when inserted in the insertion hole of the first connection member.

6. The washing machine according to claim 5, wherein the mounting bracket is extended to a lower part of the case, and formed with a mounting hole to which the second connection member is mounted.

7. The washing machine according to claim 1, wherein the front supporting plate has a via hole so that the fastening member can be passed through the front supporting plate from the front side and then inserted in the fastening hole of the second connection member.

8. The washing machine according to claim 1, wherein the second connection member further comprises a projection part which penetrates the front supporting plate to fix a mounting position of the drain pump with respect to the front supporting plate, and the front supporting plate is equipped with a projection insertion hole to insert the projection part therein.

9. The washing machine according to claim 8, wherein the projection part includes a locking portion formed on a front end of the protrusion part to prevent the projection part from being separated from the projection insertion hole.

10. A washing machine having a drain pump mounted to a cabinet of the washing machine, the cabinet including a base plate having a front supporting plate extended upward, and the drain pump being mounted to the front supporting plate, comprising:

a case having a mounting hole;

a buffering member mounted to the mounting hole; and a connection member inserted in the buffering member and fastened to the cabinet, wherein the connection member includes a fastening hole and a projection part which penetrates the front supporting plate to fix a mounting position of the drain pump with respect to the front supporting plate, the front supporting plate being equipped with a projection insertion hole to insert the projection part therein.

11. The washing machine according to claim 10, wherein the buffering member is disposed at an interval from the cabinet.

12. The washing machine according to claim 11, wherein the buffering member is equipped with an insertion hole to insert the connection member.

13. The washing machine according to claim 12, further comprising a fastening member passed through the cabinet inserted in the fastening hole.

14. A washing machine comprising a cabinet, a water tub mounted in the cabinet to hold wash water therein, and a drain pump discharging the wash water from the water tub, the cabinet including a base plate having a front supporting plate extended upward, and the drain pump being mounted to the front supporting plate, wherein the drain pump comprises:

a case, a mounting bracket disposed at one side of the case to mount the drain pump to the cabinet; and a mounting hole formed at the mounting bracket to insert a connection member connected to the cabinet;

wherein the connection member includes a first member connected from an inside of the cabinet to a front side of the cabinet, and a second member enclosing an outside of the first member to thereby prevent vibration transmission between the drain pump and the cabinet, and the second member includes a projection part which penetrates the front supporting plate to fix a mounting position of the drain pump with respect to the front supporting plate, the front supporting plate being equipped with a projection insertion hole to insert the projection part therein.

15. The washing machine according to claim 14, wherein the second member is disposed at an interval from the cabinet.

16. The washing machine according to claim 14, further comprising a fastening member passed through the cabinet and fastened to the first member so that the case is mounted to the cabinet, wherein the first member has a fastening hole to insert the fastening member.

* * * * *

UNITED STATES PATENT AND TRADEMARK OFFICE

CERTIFICATE OF CORRECTION

PATENT NO. : 8,176,756 B2
APPLICATION NO. : 12/453670
DATED : May 15, 2012
INVENTOR(S) : Woong Sub Yim et al.

It is certified that error appears in the above-identified patent and that said Letters Patent is hereby corrected as shown below:

Title Page Column 1, After
"(65) Prior Publication Data

US 2010/0095713 A1 Apr. 22, 2010", insert

--(30) Foreign Application Priority Data

Oct. 20, 2008 (KR) ..... 2008-102774--.

Signed and Sealed this
Tenth Day of July, 2012

David J. Kappos

David J. Kappos
*Director of the United States Patent and Trademark Office*